United States Patent [19]

Sabranski et al.

[11] 4,120,246

[45] Oct. 17, 1978

[54] SUBMARINE EXPLOSIVE CABLE CUTTING DEVICE TOWED BY A TOWING CABLE

[75] Inventors: Udo Sabranski; Jochen Schmitt, both of Willich, Fed. Rep. of Germany

[73] Assignee: Rheinmetall GmbH, Duesseldorf, Fed. Rep. of Germany

[21] Appl. No.: 731,829

[22] Filed: Oct. 12, 1976

[30] Foreign Application Priority Data

Oct. 30, 1975 [DE] Fed. Rep. of Germany ..... 2548595

[51] Int. Cl.[2] ..... F42B 3/08

[52] U.S. Cl. ..... 102/24 HC; 114/221 A

[58] Field of Search ..... 102/24 HC; 89/1 B; 114/221 A

[56] References Cited

U.S. PATENT DOCUMENTS

| | | | |
|---|---|---|---|
| 2,920,532 | 1/1960 | McBride | 89/1 B |
| 3,773,009 | 11/1973 | Pecksen | 114/221 A |
| 3,776,165 | 12/1973 | Sabranski | 114/221 A |

FOREIGN PATENT DOCUMENTS

| | | | |
|---|---|---|---|
| 750,964 | 6/1956 | United Kingdom | 102/24 HC |

*Primary Examiner*—Verlin R. Pendegrass

[57] ABSTRACT

A submarine explosive device for cutting anchoring chains or cables of sea mines. The device is towed through the water by a mine sweeping vessel via a towing cable. The device includes a gripper body which has a pair of parallel shank portions extending in the towing direction and defining a gripper mouth therebetween for catching the anchoring chains or cables of sea mines. A stabilization float is releasably connected to the gripper body. A release plate is mounted in the throat of the gripper mouth and is adapted to ignite an explosive charge mounted in one of the shank portions of the gripper body. The towing cable is removably mounted in a longitudinal groove extending through the gripper body. Towing cable protecting means are mounted in the other shank portion of the gripper body. The portion of the gripper body in which the explosive charge is housed can be sheared off the remainder of the gripper body when a predetermined force, applied to this portion of the gripper body, is exceeded.

22 Claims, 5 Drawing Figures

SUBMARINE EXPLOSIVE CABLE CUTTING DEVICE TOWED BY A TOWING CABLE

BACKGROUND OF THE INVENTION

The invention relates to a submarine explosive cable cutter towed by a cable and adapted to cut the anchoring chains or steel cables of sea mines in a mine sweeping operation. The cable cutter includes a gripper body which has a stabilizing float and a gripper mouth adapted to catch an anchoring chain in a mine sweeping operation. At the throat of the gripper mouth there is mounted a pressure-actuated release plate which is operatively connected to an ignition needle via a plurality of safety means. The ignition needle is adapted to detonate an explosive charge mounted in the housing of the device for cutting the anchoring cable or chain of a sea mine.

The known submarine explosive cable cutting devices have the common drawback that, in the event the device does not detonate, i.e., it is a dud, the device is hauled on board of a mine sweeping vessel in a condition whereby all of the safety means are released, that is a body representing a life bomb is hauled aboard. For example, if the device is inadvertently, forceably impacted while being hauled aboard the mine sweeping vessel, which occurs not too infrequently, the igniting means of the submarine explosive cable cutter may be unintentionally released.

A further drawback resides in the arrangement of the igniting means and the explosive charge laterally from the towing cable. This arrangement causes the incoming anchor chain to be disposed a considerable distance from the towing cable, which causes a large twisting moment to be imparted on the gripper body. Due to such an arrangement there frequently occurs a malfunctioning of the igniting means, and damage or even rupture of the gripper body itself.

There is disclosed, on the other hand, a cable cutting device in German published patent application No. 1 949 389 wherein the ignition and cable cutting means are combined with the stabilizing float by connecting means. The latter means are, due to the recoil which occurs upon igniting the explosive charge, subject to be ruptured and to release the cable cutting means. Here too there can occur a recoil even when the ignition does not occur, so that in this case also the cable cutting device can be transported on board of the mine sweeping vessel with some or all of its safety means in a released condition.

SUMMARY OF THE INVENTION

It is a principle object of this invention to provide a submarine explosive cable cutter for cutting submerged anchoring chains or cables of sea mines in which the afore-mentioned drawbacks are avoided.

The cable cutter of this invention functions more safely and securely than the devices of the state of the art and render an effective detonating force while at the same time being of simple and light construction. The cable cutting device of this invention can be rapidly moved onboard of a mine sweeping vessel and can be activated even by untrained personnel.

These objects are attained by the device of this invention by providing the gripper body with a stabilization float having a handle. The gripper body is also provided with a groove for accomodating the cable which includes self-braking locking means. The device further includes cutting means for the anchoring chains or cables of sea mines which comprises a protecting device for the towing cable disposed adjacent to the towing cable. Further there is provided a high yield explosive charge mounted at a distance from the towing cable and adjacent to the gripper mouth of the gripper body. Further the ignition means are disposed in the throat of the gripper mouth. The cutting means are disengageably connected to the gripper body so that, in the event certain pressure forces acting on the cutting unit are exceeded, the latter can be sheared off from the gripper body. The cutting unit is, for this purpose, disengageably connected to the gripper body by means for a dove-tailed shaped connecting member. This dove-tailed-shaped connecting member is held in position on the gripper body by means of shear pins that can be sheared off if a predetermined force is applied thereto.

In addition thereto the gripper body is, in accordance with this invention, provided with a plurality of pivotally mounted snap levers which are disposed along the groove through which the towing cable extends. These snap levers form, when properly pivoted, protuberances extending into the groove through which the towing cable extends, thereby narrowing the passage for the towing cable by bearing against a wall of the groove. When the snap levers are so positioned in a closed position they maintain the towing cable in the groove. When the protuberances of the snap levers are pivoted out of the groove their bearing surfaces move away from the towing cable and permit the exiting of the towing cable from the groove.

The arrangement further includes a conically shaped clamp which is mounted on the towing cable and which coacts with a vibration dampening body mounted on the gripper body.

The front portion of the gripper body, relative to the pulling direction of the towing cable, which includes the towing cable groove, includes also an arcuately shaped portion which facilitates the running in of the anchoring chain.

A further feature of the invention resides in that the arrangement includes cable protecting means which extend parallel to the towing cable and adjacent thereto and which consist of a combination of a plurality of light and heavy metal, synthetic and ceramic material layers which protect the towing cable in the event of penetration of the cutting blast of the explosive charge. The cable protecting means and the cutting explosive load are respectively mounted in two parallelly extending shanks which form the gripper mouth, the throat of which is formed by the release plate of the igniting means.

The high yield cutting detonating charge consists, in accordance with the invention, of an extended hollow explosive charge. This charge is housed in a saddle roof shaped metallic liner which has parallelly walls which are extended so that a blast stream distance is provided between the liner base and the housing bottom.

The explosive charge is disposed in a sealable sea water and pressure proof housing which is reinforced at the edges facing the incoming anchoring chains by means of bulge-shaped edge protecting means.

An igniter is provided between the gripper body and the explosive cutting charge which, according to the invention, consists of a rotor-detonator and a punch bolt. Both of the last-mentioned two elements form a part of a hydraulic channel system which is adapted to be subjected to the necessary water pressure when the explosive cable cutting device is immersed into water. When the release plate is subjected, subsequent to immersion, to punch-like loading a rotation of the rotor-detonator is effected and the igniting of the detonator occurs.

The release plate is connected via a piston rod with a working piston which is under the influence of a return spring. The piston channel which is fed with water by means of a lateral feed channel and is connected at its front and rear portions with lateral channels; the frontal lateral channel leads to the rotor and the rear lateral channel leads to the punch-bolt.

The rotor has a blind channel which extends parallel to the detonator and has an inlet which is in communication with the forward lateral channel when the rotor is not in an active position, so that when the working piston is punched inwardly against the release plate, the water column which is present in the forward lateral channel is pressure loaded, which in turn causes a turning moment in the rotor against the force of a coil spring continuously urging the rotor into its inoperative position, which effects a rotation of the rotor into the ignition-ready position.

A further pushing in of the working piston causes the forward lateral channel to be closed by the working piston and to be rendered pressureless thereby, while in the rearward lateral channel a water pressure builds up, which causes a forward snapping of the punch bolt, which is provided with a piston-like collar, against the rotor detonator.

The hydraulic channel system is, in accordance with the invention, arranged in such a way that it can only be utilized with water. Finally, it should be noted that the working piston can only build up the necessary hydraulic pressure for ignition, when the release plate is loaded in a punch-like manner by a predetermined minimal force.

The release plate is secured by means of a releasably mounted safety member or pin which is arranged between the release plate and the working piston on the piston rod. The punch bolt is also provided with a sefty means which consists of a removable pin mounted in the rear end of the punch bolt and bearing against the housing. The rear end of the punch bolt projects from the ignition housing. The safety pins respectively secure the release plate and the punch bolt during start and transport of the submarine explosive cable cutting device.

The explosive cable cutting device is designed as a one way single use device, whereby for its complete destruction and removal from the towing cable there are provided breaking seams in the gripper body in the region of the towing cable groove.

The entire device is shaped and streamlined in such a way that the flow center of gravity of the submarine cable cutting device relative to the center of gravity of the entire arrangement is selected in such a way that the gripper body with the stabilization float assumes already, at the slightest movement through the water, a position parallel to the water surface in which the gripper mouth faces in the direction of travel.

Furthermore, the cable cutting device in its entirety is shaped in such a way that either one of the two flat surfaces may be the top surface for a correct functioning of the device.

BRIEF DESCRIPTION OF THE DRAWINGS

The objects and features of the invention may be better understood with reference to the following detailed description of an illustrative embodiment of the invention, taken together with the accompanying drawing, in which.

DESCRIPTION OF THE PREFERRED EMBODIMENT

Figure 1:
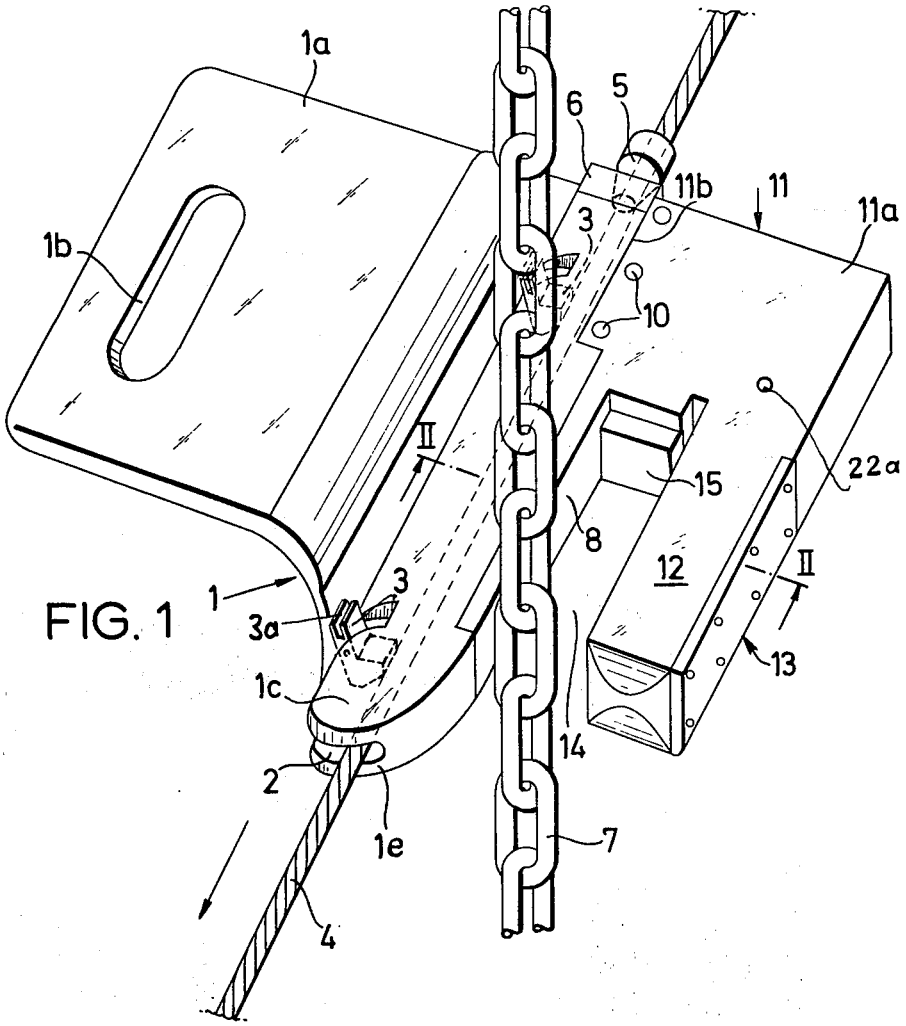
FIG. 1 is a view in perspective of the submarine cable cutting device of this invention.

Referring now to the drawing there is illustrated an explosive cable cutting device the gripper body of which is connected to a stabilizing float 1*a* provided with a handle 1*b*. The stabilizing float 1*a* is curved and ends at the broad and high back portion 1*c*. The portion 1*c* includes a longitudinally extending groove 2 through which a towing cable 4 is adapted to extend.

Figure 2:
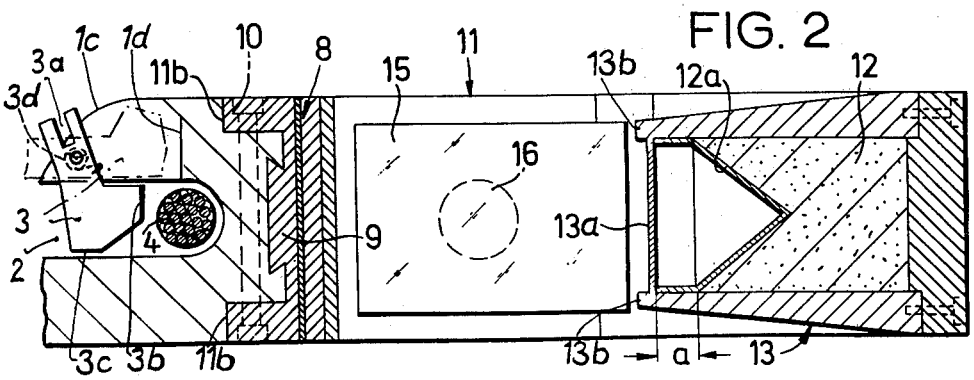
FIG. 2 is a cross-sectional view along line II — II of the submarine cable cutting device of FIG. 1.

A plurality of snap levers 3 are pivotably mounted along the back portion 1*c*. Each one of the snap levers 3 includes a protruding portion 3*b* which can be pivoted into the groove 2 until a stop surface 3*c* of the lever 3 arrests the movement of said lever. Each lever is provided with a coil spring 3*d* which maintains the lever 3 in the groove 2 so that the towing cable can be inserted in the groove 2 but can not thereafter again be removed therefrom, because the levers have been snapped into the groove 2. The levers 3 maintain the towing cable 4 thereafter in the groove 2. As can be noted from FIG. 2, the snap levers 3, when pivoted out of the groove 2, leave the latter completely so that the mouth of the groove 2 is fully exposed. The portion 1*c* is thus deliberately weakened at the region 1*d* so that the complete destruction and removal of the gripper body is facilitated after the anchor chain 7 has been cut, that is the device is constructed for a one way use.

The levers 3 are provided with key surfaces 3*a* adapted to receive a screw driver or the like which makes possible to pivot the levers 3 against the force of the coil spring 3*d* and thereby expose the groove 2. Thus, for example, when the gripper body 1 has been damaged and is to be removed from the towing cable 4, this can be accomplished by so pivoting the levers 3 by means of a non-illustrated screw driver.

The towing cable 4 is provided at predetermined locations with conically shaped clamps 5, by means of which the movement of the submarine explosive cable cutter along the towing cable 4 is limited. In order to avoid, at contact of the submarine explosive cable cutter with the conically shaped clamp 5, excessively strong impact forces and to obtain a sufficiently effective dampening of transmitted high frequency oscillations there is provided at the backside of the stabilization float 1, which faces away from the towing direction of the towing cable 4, in the region of the groove 2 a dampening member 6 preferably made out of a metallic dampening material.

At the side adjacent to the towing cable groove 2 and facing in the towing direction there is provided on the stabilization float a running in portion 1*e* for the anchoring chain 7, so that the latter is not caught or jammed and can smoothly run into the interior of the gripper mouth 14.

Adjacent to the back portion 1*c* of the stabilization float there is disposed a cable protecting member 8, which has the task to prevent damage to the towing cable 4 during detonation of the detonating cutting charge 12. The cable protecting member 8 consists of a plurality of layers of light and heavy metal, synthetic material and ceramic material. These layers are combined in such a way that they safely prevent a penetration of the explosive cutting blast and in addition thereto dampen the penetrating shock wave. The cable protecting member 8, the ignition member 11 and the cutting member 13 and housing therefor which incorporates the explosive charge 12 are releasably connected with the stabilization float in a particularly advantageous manner. Thus the cable protecting member 8 is slid by means of dove-tailed-shaped longitudinal guide member 9 onto the high back portion 1*c* of the stabilization float and is maintained in position thereon by means of a plurality of shear pins 10. These shear pins 10 extend through both flanges 11*b* of the ignition member housing 11*a* as well as to the middle portion of the stabilization float.

The housing 13 for the explosive charge 12 is situated opposite the cable protecting member 8, and these two members form two parallelly extending shanks between which the gripper mouth 14 is situated. The throat or bottom of the gripper mouth is formed by the release plate 15 which coacts with the ignition member 11.

The cutting explosive charge 12 is formed as a high yield-cutting charge. This charge consists of a linear shaped charge which has a saddle roof shaped metal insert 12*a* which favors the formation of a shaped charge jet "*a*" between the base of the metal insert and the bottom 13*b* of the housing 13. The space "*a*" is formed by a pair of parallelly extending walls. The cutting explosive charge is disposed in a sealable sea water proof and pressure proof housing 13 which has a bottom 13*a* which is reinforced by a pair of flange members 13*b* facing the anchor chain 7. The flange members 13*b* suffice to protect the relatively thin housing bottom 13*a* from damage during introduction of the chain.

Figure 3:
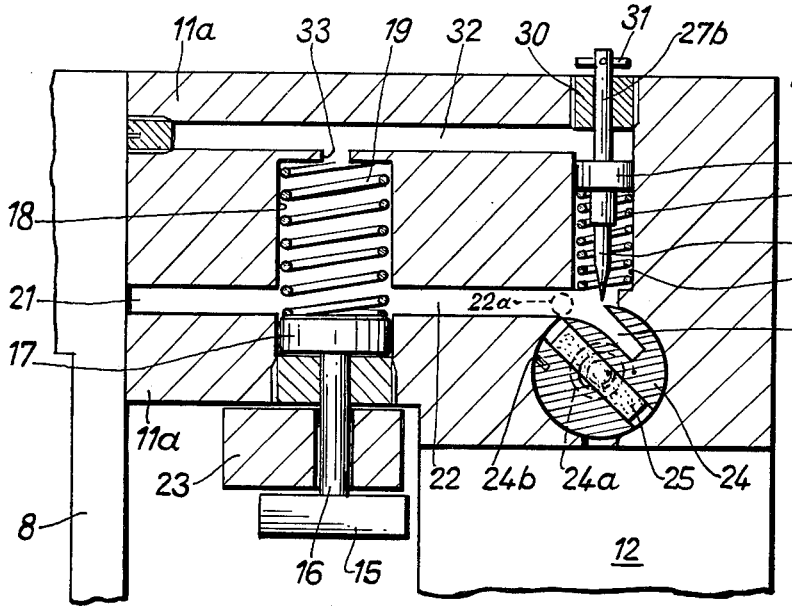
FIG. 3 – 5 illustrates schematically the construction and function of the ignition means of the cable cutting device of this invention in three different operational stages.

As has already been described above, the release plate 15 is placed in front of the ignition member housing 11*a* relative to the towing direction and forms the inner end or throat of the gripper mouth 14. A safety member or pin 23 is mounted between the release plate 15 and the ignition member housing 11*a*. This member 23 is removed when the submarine explosive cable cutting device is activated. After removal of the safety member 23 there is established a functional relationship between the release plate 15 and the actuating piston 17 via the piston rod 16. When the actuating piston 17 is held in an inactive locked position by means of the safety member 23 it assumes the position illustrated in FIG. 3 in which the leading surface of the piston 17 is aligned with the channel 21 and is urged by means of a coil spring 19 against a stop member 20. To the left of the cylinder 18 for the piston 17 there is disposed a channel 21 which leads into the cylinder 18 and which fills with water as soon as the submarine explosive cable cutting device is thrown out with the towing cable 4 and is submerged below the water surface. In such a case, of course, the safety pin 23 has already been removed. The channel 21 continues at the right side of the cylinder 18 as a continuing lateral channel 22 one end of which is tangential to the rotor 24 and the therein disposed detonator 25. A narrow blind channel 26 is disposed parallel to the detonator 25 in the rotor 24. When the rotor is in its non-active, non-actuated position the inlet opening of the narrow channel 26 smoothly leads into the forward end of the lateral channel 22. The bore 22*a* also leads into the lateral channel 22 at or near its forward end.

A mechanical punch bolt 27 coacts with the detonator 25. The punch bolt 27 is slideably guided in the punch bolt channel 28 by means of a piston-like collar 27*a*. The punch bolt spring 29 bears against the punch bolt collar 27*a* so that the point of the bolt does not reach the detonator 25. The rearward end 27*b* of the punch bolt 27, which is guided in a plug 30, protrudes from the ignition housing 11*a* and is secured by means of a removable pin 31. The distance between the plug 30 and the collar 27*a* of the punch bolt 27 is about equal to the diameter of the rearward lateral channel 32. The lateral channel is in communication with the cylinder 18 for the actuating piston 17 via the bore 33. The rotor 25 is under the influence of a coil spring 24*a* which is biased for rotation of the rotor 24, whereby the rotor 24 is constantly urged into the inactive position illustrated in FIG. 3.

The rotor 24 has at its periphery a ball stop 24*b* which maintains it in the ignition ready-position of the rotor 24 once the rotor has assumed such a position.

The arrangement of the ignition means of the invention operates as follows:

In order to trigger the arrangement it is necessary to remove the safety pin 23 and the safety pin 31. The activating of the submarine explosive cable cutting device is carried out onboard of a mine sweeping vessel. Thereafter the submarine explosive cutting devices are one after the other introduced with their towing cable 4 into the water.

The flow center of gravity of the device is relative, to center of gravity of standstill, selected in such a way that the device assumes a horizontal position with the gripper mouth facing in the tow direction even when the device is towed very slowly through the water. The channel system 18, 21, 22, 26 and 32 is filled with water and the channels are calibrated for the viscosity of sea water.

Figure 4:
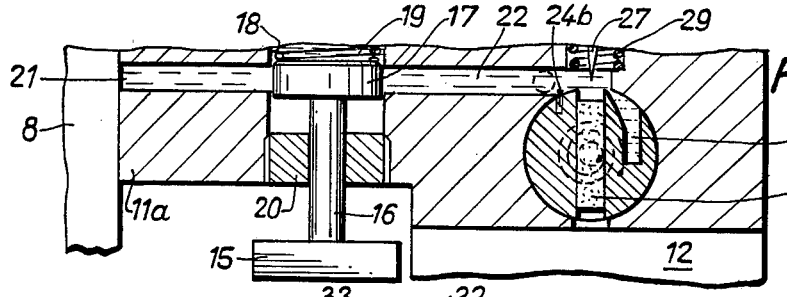
Figure 5:
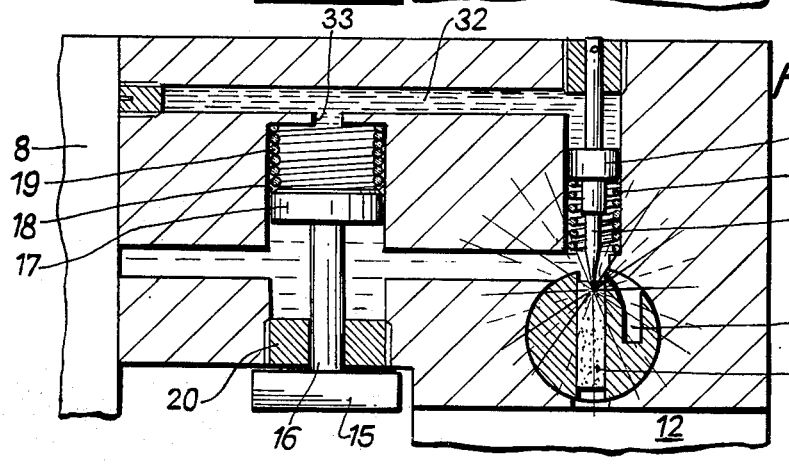

When an anchoring chain 7 or a steel towing cable of a sea mine is contacted by the towing cable 4, it runs along the towing cable 4 and passes the running in portion 1*e* which guides it into the gripper mouth 14. It is necessary that a minimum velocity is maintained as the anchoring chain 7 enters the gripper mouth 14 in order to activate the release plate 15. The device is so calibrated that incoming drift wood or fish do not impact the release plate 15 sufficiently to activate the submarine cable cutting device. The pressure exerted on the release plate 15 permits the actuating piston 17 to snap forward whereby there is exerted on the water column present in the lateral channel 22 and the blind channel 26 such a pressure that the rotor 24 assumes the ignition-ready position against the force of the turning spring 24*a*, such position being illustrated in FIG. 4. The ball stop 24*b* is now released and snaps forward thereby preventing the return of the rotor 24 into the inactive position.

The actuating piston 17 now blocks, as it moves forward into the bore 18, the penetration channel 21 and the frontal lateral channel 22, so that as the water runs out of these channels the water pressure decreases in this region. The actuating piston 17 now pushes the water column in the piston bore 18 and in the rearward lateral channel 32 in front of it whereby the piston-like collar 27*a* with the punch bolt 27 snaps forward and penetrates into the detonator 25, mounted in the rotor 24, thereby igniting this detonator 25. The igniting blast of the detonator 24 now causes a sequential igniting of the transfer charge and the cutting charge 12. The anchor chain 7 is thereby smoothly punched through so that the sea mine floats to the water surface and can be deactivated. Despite the careful handling of the towing cable 4 to avoid damage thereof, by means of the cable protecting member 8, means are provided to ensure that no parts of the submarine explosive cable cutting device remain on the towing cable 4 after detonation. This is accomplished by providing the arrangement with a plurality of weakened seams 1*d* in the region of the snap levers 3.

If, as a result of malfunctioning of the ignition means, the pressure exerted by the anchor chain 7 on the release plate 15 continues to increase until it reaches a severalfold magnitude of a force of 60kp, the shear pins 10 are destroyed so that the entire cutting arrangement is separated from the remainder of the gripper body 1 and drops to the sea floor. The anchor chain 7 is thereby again set free, on the one hand, so that it can run into the following submarine explosive cable cutting device, and on the other hand, the remainder of the gripper body which remains mounted on the towing cable 4 can again be complemented by means of a new cutting arrangement which can be mounted thereon.

The submarine explosive cutting device is in its entirety constructed in such a way that it assumes a horizontal swimming and floating position even when it is only slowly moved through the water whereby the gripper mouth 14 remains open and faces in the towing direction. This characteristic of the submarine explosive cable cutting device is independent with respect to which of the two flat sides form the upper surface of the floating device.

Since the cutting charge 12 is disposed on the shank situated opposite and spaced from the towing cable 4 the running in anchor chain 7 moves between the cable protecting member 8 and the housing 13 for the cutting charge 12 and produces a minimal turning moment which is exerted by the anchor chain 7 on the submarine cable cutting device. Thereby damage or even breakage of parts of the device are avoided.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A submarine explosive cutting device adapted to cut the anchoring chains or cables of sea mines when towed by a towing cable in a mine sweeping operation, comprising in combination, a gripper body having a pair of parallel shank portions projecting in the towing direction and forming a gripper mouth adapted to receive an anchoring chain or cable of a sea mine;

a stabilization float having a handle releasably connected to a first shank portion of said pair of shank portions of said gripper body;

a release plate operatively mounted between said pair of shank portions at the bottom of said gripper mouth;

ignition means mounted in said gripper body and being operatively connected to said release plate;

an anchor chain or cable cutting unit including an explosive charge disposed at least partially in the other one of said pair of shank portions and being adapted to coact and be detonated by said ignition means;

said stabilization float having a portion with a groove extending along said first shank portion which is adapted to receive the towing cable and further having towing cable protecting means extending along said first shank portion at one side of said gripper mouth;

locking means operatively mounted on said stabilization float and adapted to prevent the towing cable separating from said cutting device; whereby said gripper body which includes the anchor chain or cable cutting unit is releasably connected to the stabilization float of the cutting device in such a way that when a predetermined force, applied to said gripper body, is exceeded said gripper body is sheared off the remainder of said cutting device.

2. The submarine explosive cutting device as set forth in claim 1, wherein the gripper body has a dove-tailed shaped projection portion, said stabilization float has a recess which is adapted to matingly receive said dove-tailed shaped portion, and a plurality of shear pins extending through said gripper body, said recess of said dove-tailed shaped portion to hold together said stabilization float and said gripper body.

3. The submarine explosive cutting device as set forth in claim 1, wherein said locking means include a plurality of levers pivotally mounted on said stabilization float along said groove, said levers being adapted to move from a locking position to a release position and vice versa, when in said locking position, at least a portion of said levers projects into said groove and prevents the exiting therefrom of said towing cable and when in said release position the groove is exposed so that the towing cable may freely exit or enter said groove; and first biasing means connected to each lever and continuously urging it into said closed position.

4. The submarine explosive cutting device as set forth in claim 3, wherein said portion of each lever which is adapted to project into said groove when the lever is in the closed position includes a stop surface which is adapted to contact the wall of said groove and thereby fix the lever in said closed position.

5. The submarine explosive cutting device as set forth in claim 3, wherein each lever has a recess adapted to receive a key for pivoting said lever from said release position to said closed position and vice versa.

6. The submarine explosive cutting device as set forth in claim 1, including a conically shaped stop member having an axial bore, the towing cable extending through the axial bore and the stop member being fixedly mounted on the towing cable, a dampening member mounted at the side of the stabilization float facing away from the towing direction and adapted to absorb and dampen shocks from said stop member when it impacts thereon.

7. The submarine explosive cutting device as set forth in claim 1, wherein said stabilization float has an arcuately shaped side which facilitates the entry of the anchoring chain or cable into the gripper mouth.

8. The submarine explosive cutting device as set forth in claim 1, wherein said towing cable protecting means has a plurality of layers of material which block the penetration of the explosive blast of said explosive charge, said layers of material being selected from the group of light metals, heavy metals, synthetic materials and ceramic materials.

9. The submarine explosive cutting device as set forth in claim 8, wherein the gripper mouth is formed at one side by said cable protecting means and at its other opposite side by said anchor chain or cable cutting unit and the bottom of the gripper mouth is at least partially occupied by said release plate.

10. The submarine explosive cutting device as set forth in claim 1, wherein said explosive charge is elongated and at least partially hollow, and wherein said anchor chain or cable cutting unit includes a saddle-roof shaped metal insert having lateral opposite walls which provide a space for the formation of a blast beam between the explosive charge and the gripper mouth.

11. The submarine explosive cutting device as set forth in claim 10, wherein said cutting unit includes a sea water proof and pressure proof housing which has a pair of flanges projecting into the gripper mouth and which protect the housing from damage by an anchor chain or cable of a sea mine.

12. The submarine explosive cutting device as set forth in claim 1, wherein said ignition means are mounted in said gripper body between said cutting unit and said dove-tailed shaped portion, said ignition means including a rotor rotatably mounted in a first bore of the gripper body and a punch bolt reciprocally mounted in a second bore of the gripper body and adapted to impinge on said rotor when subjected to a predetermined hydraulic pressure, said gripper body having hydraulic channel means which are in communication with said first and second bore and have an inlet for the introduction of sea water, said release plate having piston means reciprocally mounted in a third bore in said gripper body, said third bore being in communication with said channel means, whereby when said release plate is depressed by an anchor chain or cable of a sea mine said piston means effect a sequential rise in water pressure in said first and second bores to cause the igniting of the ignition means.

13. The submarine explosive cutting device as set forth in claim 12, wherein said piston means include a piston reciprocally mounted in said third bore, a piston rod connecting said piston to said release plate, a coil spring urging said piston toward the bottom of the gripper mouth, said channel means having first and second lateral channels respectively in communication with said first and second bores and also with said third bore.

14. The submarine explosive cutting device as set forth in claim 13, said rotor having a first bore and a second parallel blind bore, a detonator mounted in said first bore, said rotor being adapted to rotate from a first inactive position to a second active position in which the ignition means can be ignited, the second blind bore having an inlet which is in communication with said first lateral channel when the rotor is in the inactive position, whereby when the release plate is depressed the piston moves inwardly in the third bore and pushes a water column through the first lateral channel and thereby rotates the rotor into its active position, and a spring connected to the rotor continuously urging it into its inactive position.

15. The submarine explosive cutting device as set forth in claim 14, whereby when said piston is depressed further by the release plate into said thrid bore it blocks the first lateral channel and causes a drop in water pressure therein, while simultaneously causing a rise in water pressure in the second lateral channel and thereby causing the punch bolt to snap forward and impinge on the detonator in the rotor.

16. The submarine explosive cutting device as set forth in claim 15, wherein said channel means are calibrated in such a way that they can only be used with water.

17. The submarine explosive cutting device as set forth in claim 16, wherein said release plate can only be depressed sufficiently for igniting the ignition means against the action of its spring if it is impacted by a sufficiently large predetermined force.

18. The submarine explosive cutting device as set forth in claim 17, including a first safety pin operatively connected to said release plate so that the release plate can not be depressed unless said first safety pin has been operatively disconnected therefrom.

19. The submarine explosive cutting device as set forth in claim 18, wherein said punch bolt has a rear portion projecting from said gripper body, a second safety pin operatively connected to the rear projecting portion of said punch bolt.

20. The submarine explosive cutting device as set forth in claim 19, wherein said submarine explosive cutting device is a one way device which is completely destroyed and removed from the towing cable after one use, said gripper body having a weakened portion adjacent to its groove which facilitates the breaking and removal of the device from the towing cable.

21. The submarine explosive cutting device as set forth in claim 20, wherein the flow center of gravity and center of gravity at standstill of the cutting device are such that the gripper body and stabilization float assume a position in which the gripper mouth faces in the towing direction even when the cutting device is towed at a low velocity.

22. The submarine explosive cutting device as set forth in claim 21, wherein the cutting device is shaped and constructed in such a way that is has a substantially extended flat top and bottom and is operative irrespective of whether the top or bottom forms the top floating surface.

* * * * *